US009216839B1

(12) United States Patent
Erlinger

(10) Patent No.: US 9,216,839 B1
(45) Date of Patent: Dec. 22, 2015

(54) CARDBOARD BOX CONSTRUCTION

(71) Applicant: William G Erlinger, Simi Valley, CA (US)

(72) Inventor: William G Erlinger, Simi Valley, CA (US)

( * ) Notice: Subject to any disclaimer, the term of this patent is extended or adjusted under 35 U.S.C. 154(b) by 0 days.

(21) Appl. No.: 14/624,194

(22) Filed: Feb. 17, 2015

(51) Int. Cl.

| | |
|---|---|
| ***B65D 43/22*** | (2006.01) |
| ***B65D 5/66*** | (2006.01) |
| ***B31B 1/90*** | (2006.01) |
| ***B31B 45/00*** | (2006.01) |
| *B65D 6/08* | (2006.01) |
| *B65D 5/472* | (2006.01) |
| *B65D 5/44* | (2006.01) |

(52) U.S. Cl.
CPC ..... *B65D 5/6611* (2013.01); *B31B 1/90* (2013.01); *B31B 45/00* (2013.01); *B65D 5/441* (2013.01); *B65D 5/448* (2013.01); *B65D 5/46048* (2013.01); *B65D 7/20* (2013.01)

(58) Field of Classification Search
USPC ..... 229/198.3, 117.21, 117.18; 220/491
See application file for complete search history.

(56) References Cited

U.S. PATENT DOCUMENTS

| | | | | |
|---|---|---|---|---|
| 933,454 | A | 9/1909 | Hudson | |
| 1,472,661 | A | 10/1923 | Mengel | |
| 1,914,845 | A | 6/1933 | Cook | |
| 1,945,878 | A | 2/1934 | Breton | |
| 2,057,782 | A | 10/1936 | La Place | |
| 2,179,981 | A * | 11/1939 | Mooter et al. | 229/117.17 |
| 2,622,777 | A * | 12/1952 | Guyer | 206/427 |
| 3,128,811 | A | 4/1964 | Higgins | |
| 3,250,430 | A * | 5/1966 | Cella | 220/637 |
| 3,276,663 | A | 10/1966 | Falconer | |
| 3,837,562 | A | 9/1974 | Cali | |
| 5,181,652 | A | 1/1993 | Tanttu | |
| 5,269,455 | A | 12/1993 | Grigsby et al. | |
| 6,749,108 | B2 | 6/2004 | Naughton et al. | |
| 7,413,111 | B2 | 8/2008 | Quaintance et al. | |
| 2004/0262193 | A1 * | 12/2004 | Korhonen | 206/586 |

* cited by examiner

*Primary Examiner* — Christopher Demeree
(74) *Attorney, Agent, or Firm* — Brooks Acordia IP Law, P.C.; Douglas N. Larson

(57) ABSTRACT

One or more rods pass through the corrugations of first and second folded down flaps and across the divide between adjacent edges of the flaps of a cardboard box blank to hold the flaps together and in a closed position.

36 Claims, 11 Drawing Sheets

CARDBOARD BOX CONSTRUCTION

BACKGROUND

The present disclosure relates to cardboard box constructions and kits and to methods of assembling/disassembling them.

SUMMARY

This section provides a general summary of the disclosure and one or more of its advantages, and is not a comprehensive disclosure of the full scope of all of the features, of all of the alternatives or embodiments or of all of the advantages.

Disclosed herein is a cardboard box construction which includes (a) a cardboard carton (box) blank having opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap; and (b) a rod. The cardboard carton blank and the rod are configured such that the rod can be positioned by a user in an operative position extending between the first and second flaps, and within corrugations of both of the first and second flaps and holding the first and second flaps in folded-down closed positions with distal edges of the first and second flaps adjacent one another, the third and fourth flaps folded inside of the first and second flaps and the rod extending across the divide between the adjacent distal edges.

Also disclosed herein is a method of assembling a cardboard box construction, which includes positioning a rod relative to a cardboard carton blank. The blank has opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the second panel and the second flap. The positioning includes inserting the rod so that the rod extends between the first and second flaps and within corrugations of both of the first and second flaps and to an operative position holding the first and second flaps in folded-down closed positions with distal edges of the first and second flaps adjacent one another, and across the divide between the adjacent distal edges.

Additionally disclosed herein is a cardboard box construction that includes a rod and a cardboard carton blank. The blank has opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap. The rod extends between the first and second flaps and within corrugations of both of the first and second flaps and holds the first and second flaps in folded-down closed positions with distal edges of the first and second flaps adjacent one another, the third and fourth flaps folded inside of the first and second flaps and the rod extending across the divide between the adjacent distal edges.

Further disclosed herein is a box construction that includes first, second, third and fourth interconnected panels. The box construction further includes a corrugated first flap pivotably attached to an end of the first panel and a corrugated second flap pivotably attached to an end of the second panel, which is opposite to the first panel. The first and second flaps are folded down so as to be generally in the same plane and with distal edges adjacent one another. A rod extends in the corrugations of the first and second flaps passing between them and across the divide of the adjacent distal edges, and thereby in an operative position holding the flaps in a closed position. A user can insert the rod into the operative position to assemble the box construction and/or can remove the rod from the operative position to disassemble the box construction for break-down and flat storage.

The flaps and/or panels of this box construction can further include a rod insertion/removal opening/notch/recess in an edge in the first flap, at the fold line with the first panel (via either a hole or a fold-down punch-out), at the opposite free edge or at a central area of the first flap at a fold-down punch-out.

The box construction can further include a means for storing the rod(s) with the rod(s) removed from their flap (hold-down) operative positions and the panels and flaps (e.g., cardboard blank) in a flattened broken-down condition. The storing means can be physically connected to the broken-down cardboard blank. The storing means can include the rods positioned, for example: in corrugations of a flap and an aligned adjoining panel; releasably adhered (for example by glue or tape) to a face of a panel or flap; or in a bag (or other container) attached to a flap or panel.

The rods can be long and thin and be made of steel or bamboo, for example. They can have an enlarged or bent head at their proximal ends. They can have a slight bend to reduce the likelihood of sliding out of their operative positions.

According to at least one embodiment when the rod is in the operative position, the third and fourth flaps are folded inside relative to the first and second flaps, and the first, second, third and fourth panels are configured to form a rectangular tube. A dust shield can be positioned sandwiched between the first and second panels and the third and fourth panels and over the divide between the first and second panels.

According to at least one embodiment the rod when in the operative position does not extend into either the first panel or the second panel, and/or it extends straight across the divide.

Also disclosed herein is a cardboard carton blank, which includes: (a) opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap; and (b) at least one hole which includes: (a) a rod-insertion hole at the first fold line and in the first panel and the first flap; (b) a rod-insertion fold-down punch-out in the first panel; and/or (c) a rod-insertion recess in a distal edge of the first flap opposite to the first fold line. The at least one hole is configured to receive therein a rod so that the rod passes through corrugations of the first and second flaps when in folded-down closed positions with the third and fourth flaps folded down and inside of the first and second flaps and across the divide between adjacent free edges of the first and second flaps to at least in part hold the first and second flaps in the folded-down closed positions.

The cardboard carton blank discussed above can include the at least one hole defining at least one first hole and the rod defining a first rod. The blank can further include at least one second hole comprising: (a) a rod-insertion hole at the first fold line and in the first panel and the first flap; (b) a rod-insertion fold-down punch-out in the first panel; (c) a rod-insertion recess in a distal end of the first flap opposite to the first fold line; and/or (d) a rod-access through-opening in the first flap and spaced between the first fold line and an opposite edge of the first flap. And the at least one second hole can be configured to receive therein a second rod so that the second rod passes through corrugations of the first and second flaps when in the folded-down closed positions and across the divide to at least in part hold the first and second flaps in the folded-down closed positions together with the first rod.

The cardboard carton blank can additionally and/or alternatively include a rod-access through-opening in the first flap and spaced between the first fold line and an opposite edge of the first flap and aligned with the at least one first hole.

Instructions for disassembling and assembling the box construction can also be printed or otherwise affixed to the cardboard carton blank.

BRIEF DESCRIPTION OF THE DRAWINGS

The drawings described herein are for illustrative purposes only of selected aspects of the present teachings and not all possible implementations, and are not intended to limit the scope of the present teachings.

FIG. 9B is an enlarged view taken on circle 9B of FIG. 9A and showing an alternative flap indent configuration.

DETAILED DESCRIPTION

Figure 1:
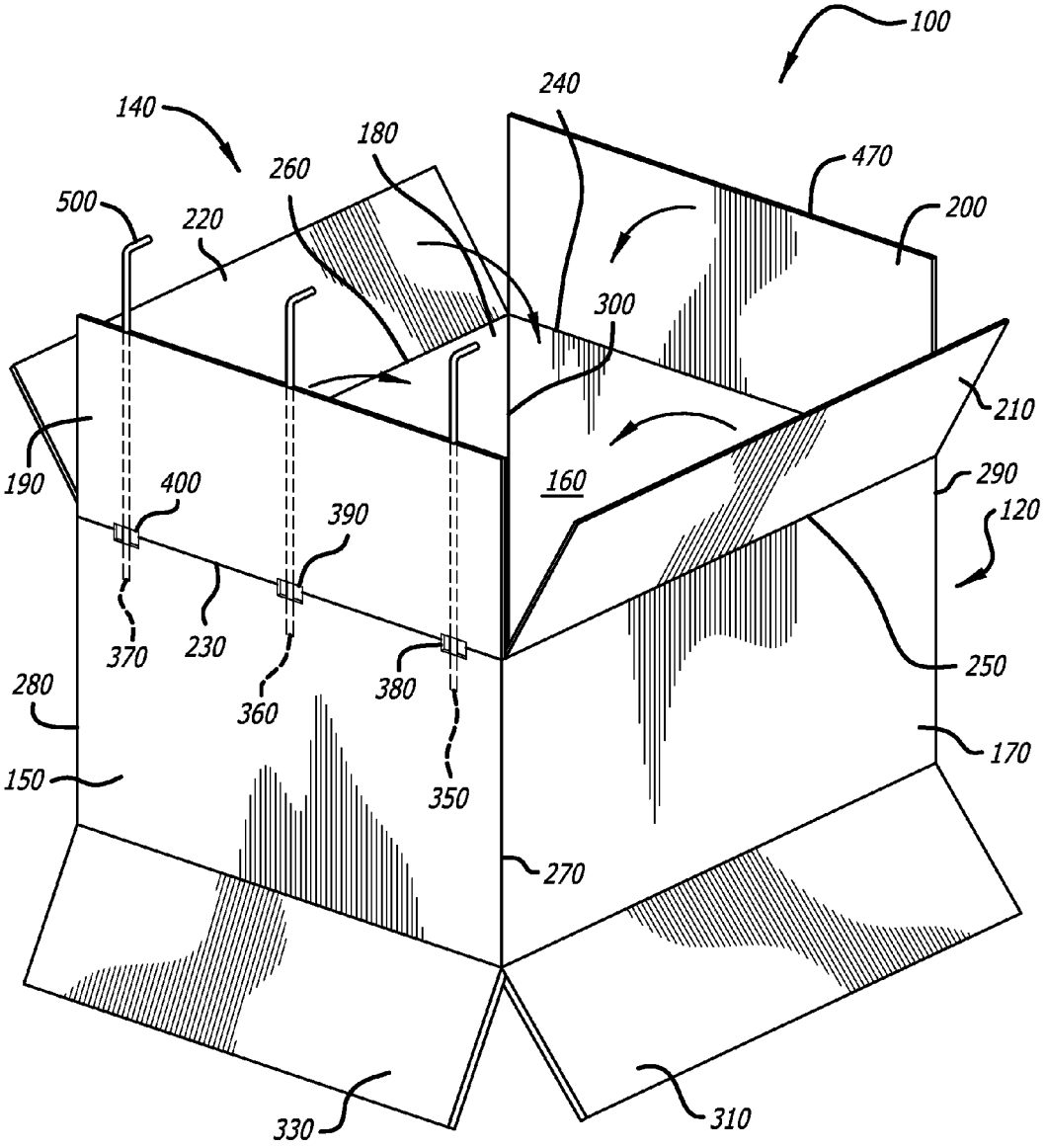
FIG. 1 is a perspective view of a cardboard box blank and rods of a construction (and method and kit) of the present disclosure.

A cardboard box construction of the present disclosure is shown generally at 100 in FIG. 1 in a partially assembled condition. Construction 100 can include a (corrugated) cardboard carton blank shown generally at 120 and a set of rods shown generally at 140.

The cardboard carton blank 120 can have opposing first and second panels 150, 160, opposing third and fourth panels 170, 180, opposing first and second flaps 190, 200, opposing third and fourth flaps 210, 220, a first fold line 230 between the first panel and the first flap, a second fold line 240 between the second panel and the second flap, a third fold line 250 between the third panel and the third flap, and a fourth fold line 260 between the fourth panel and the fourth flap. While flaps 190 and 200 are depicted in FIG. 1 as being shorter than flaps 210 and 220, it is within the scope of the disclosure for them to be longer or the same size.

The first panel 150 and the third panel 170 can be separated by a fold line 270. The first panel 150 and the fourth panel 180 can be separated by a fold line 280. The second panel 160 and the third panel 170 can be separated by a fold line 290. The second panel 160 and the fourth panel 180 can similarly be separated by a fold line 300.

The flaps 190, 200, 210, 220 can form the bottom flaps (or alternatively the top flaps) of the cardboard carton blank 120 and thus of the cardboard box construction 100. The cardboard carton blank 120 can have at the end opposite to those flaps additional corresponding flaps, namely fifth and sixth flaps 310 and seventh and eighth flaps 330. The fifth flap 310 and the third panel 170 are joined by a fold line opposite to fold line 250; the sixth flap and the fourth panel 180 are joined by a fold line opposite to fold line 260; the seventh flap 330 and the first panel 150 are joined by a fold line opposite to fold line 230; and the eighth flap and the second panel 160 are joined by a fold line opposite to fold line 240.

The set of rods 140 can include generally any number of rods with three rods 350, 360, 370 being illustrated in FIG. 1. Larger cardboard box constructions may use more than three rods; and one or two rods may be sufficient for smaller boxes, for boxes with light anticipated loads and/or where the rods are very strong. The rods and the rod ends can have different configurations as depicted and described herein. The rods, for example, can be between six and twelve inches long and have diameters between 0.06 and 0.120 inch. They can be made of steel or bamboo.

With the cardboard carton blank 120 configured such that the opposing pairs of panels form a rectangular tube (such as shown in FIG. 1) the flaps 210, 220 can be folded in and flaps 190, 200 folded down. The rods 350, 360, 370 can be removed from their storage positions, such as illustrated in FIG. 1, so that they are separated from the cardboard carton blank 120.

Figure 2:
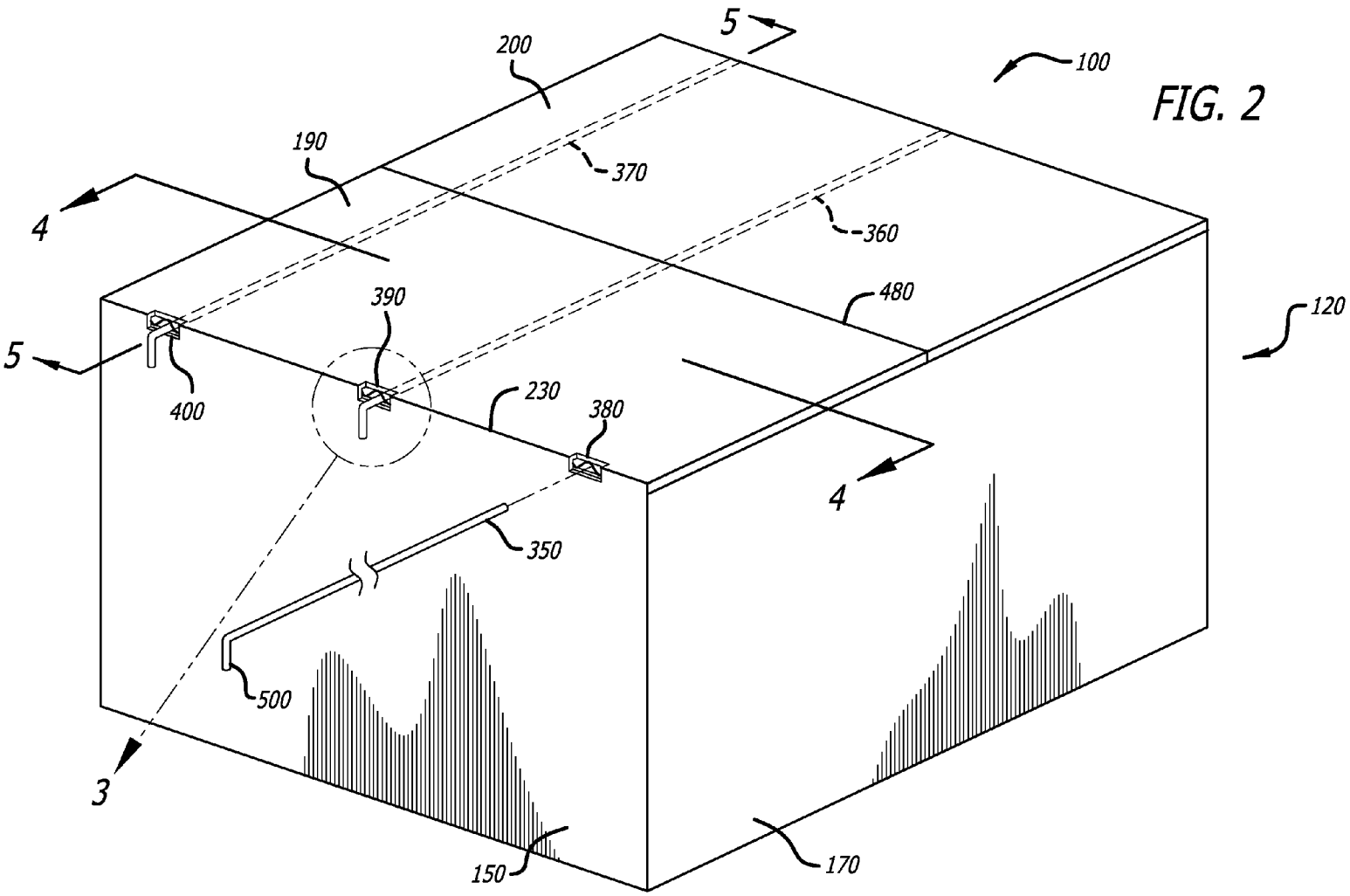
FIG. 2 is a (bottom) perspective view of the cardboard box blank and rods of FIG. 1 in a nearly completely assembled condition.

The cardboard carton blank 120 of FIG. 2 according to a first embodiment thereof can include through-holes 380, 390, 400 at the first fold line 230 and extending into both the first flap 190 and the first panel 150. Each of the through-holes can have dimensions of ¼ inch by ¼ inch, for example, and can be formed in a punch operation.

With the flaps folded in, such as illustrated in FIG. 2, it is seen that the first flap 190 is cut by the through-holes 380, 390, 400 to thereby form an open edge(s) 420 and to provide access to the corrugations 440. This is better seen in the enlarged view of FIG. 3. The hole includes a notch cut-out 450 at the "top" of the first panel 150 as seen in FIG. 3 at the first fold line 230.

Figure 3:
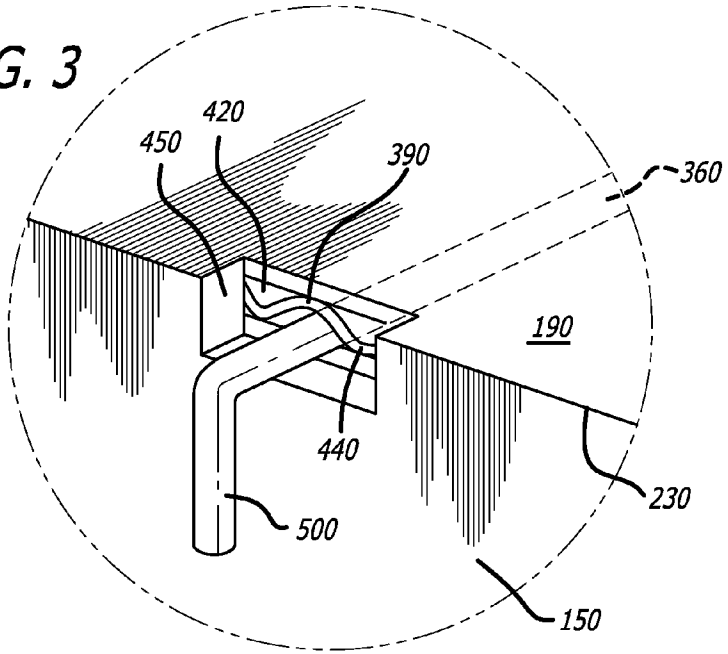
FIG. 3 is an enlarged view taken on circle 3 of FIG. 2.
Figure 4:
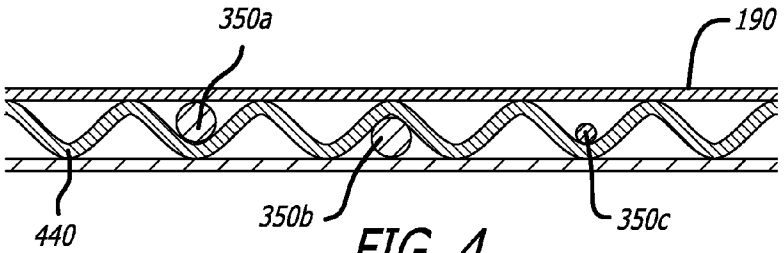
FIG. 4 is an enlarged cross-sectional view taken on line 4-4 of FIG. 2, and showing different rod positions and diameters.
Figure 5:
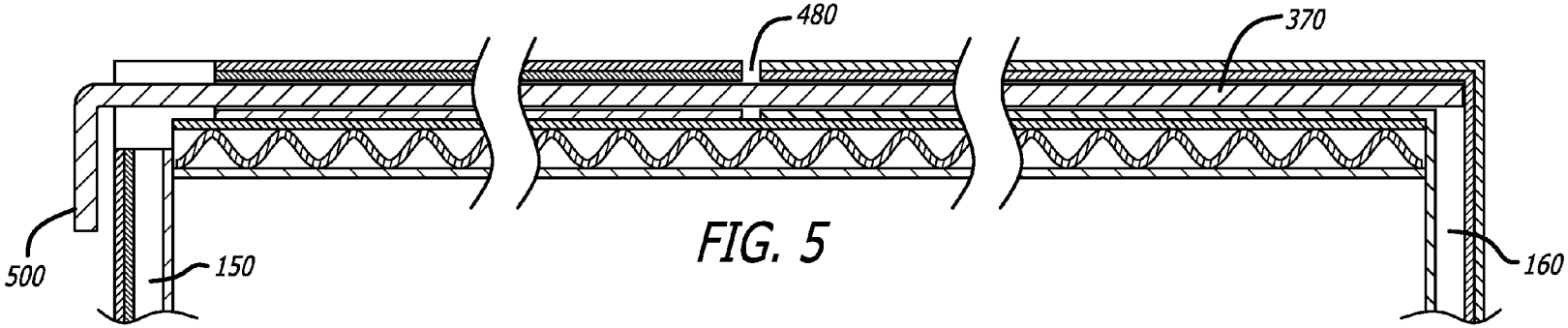
FIG. 5 is an enlarged cross-sectional view taken on line 5-5 of FIG. 2.

This notch 450 provides better access for the rod 350, 360, 370 to be inserted in through the hole 380, 390, 400 into the exposed edge 420 of the first flap 190, as can be understood from FIGS. 2 and 3. The rod is then pushed through the first flap 190 and into the corrugations of the open edge 470 of the opposite second flap 200 and then further into the second flap, until generally half of the rod is in the first flap and half is in the second flap. This can be understood from FIGS. 2, 4 and 5. The rod can pass on the outer side of the corrugations as shown by rod 350*a* in FIG. 4, or the inner side as shown by rod 350*b*. Rods 350*a* and 350*b* are large rods pursuant to this disclosure having a diameter of approximately 0.120 inch. However, the rod can be smaller having approximately half the diameter size as shown by rod 350*c* in FIG. 4, and much smaller than the area formed by the corrugation.

The rod 350 thereby bridges between the two flaps 190, 200 and across any very small gap 480 (FIG. 5) therebetween, that is, between the divide between adjacent edges of the two flaps. The rods 350, 360, 370 thereby lie between the planes of the upper and lower surfaces of the first and second flaps 190, 200. The rods also do not extend into any of the side or end panels of the carton blank 120, according to embodiments illustrated in the drawings. The rods 350, 360, 370 securely hold the first and second flaps 190, 200 closed (and outside of the folded-in flaps 210, 220) so as to support the weight of articles in the box construction 100 when it is lifted off of its support surface.

The cardboard box constructions of the disclosure can have another advantage. They can be easily disassembled by hand, stored (stored in a compact flat condition) and subsequently reassembled without tearing/damaging the carton blank and without the need for any additional parts, accessories or equipment, or even expensive packing or sealing tape. The rods 350, 360, 370 can be pulled (or pushed) out from their operative positions (FIG. 2) in an operation opposite to the assembly operation to quickly and easily disassemble the cardboard box construction 100. The cardboard carton blank 120 can be folded down to a flat condition and the rods 350, 360, 370 can be secured to it or with it in some manner, as discussed later in this disclosure with respect to FIG. 12.

Figure 6:
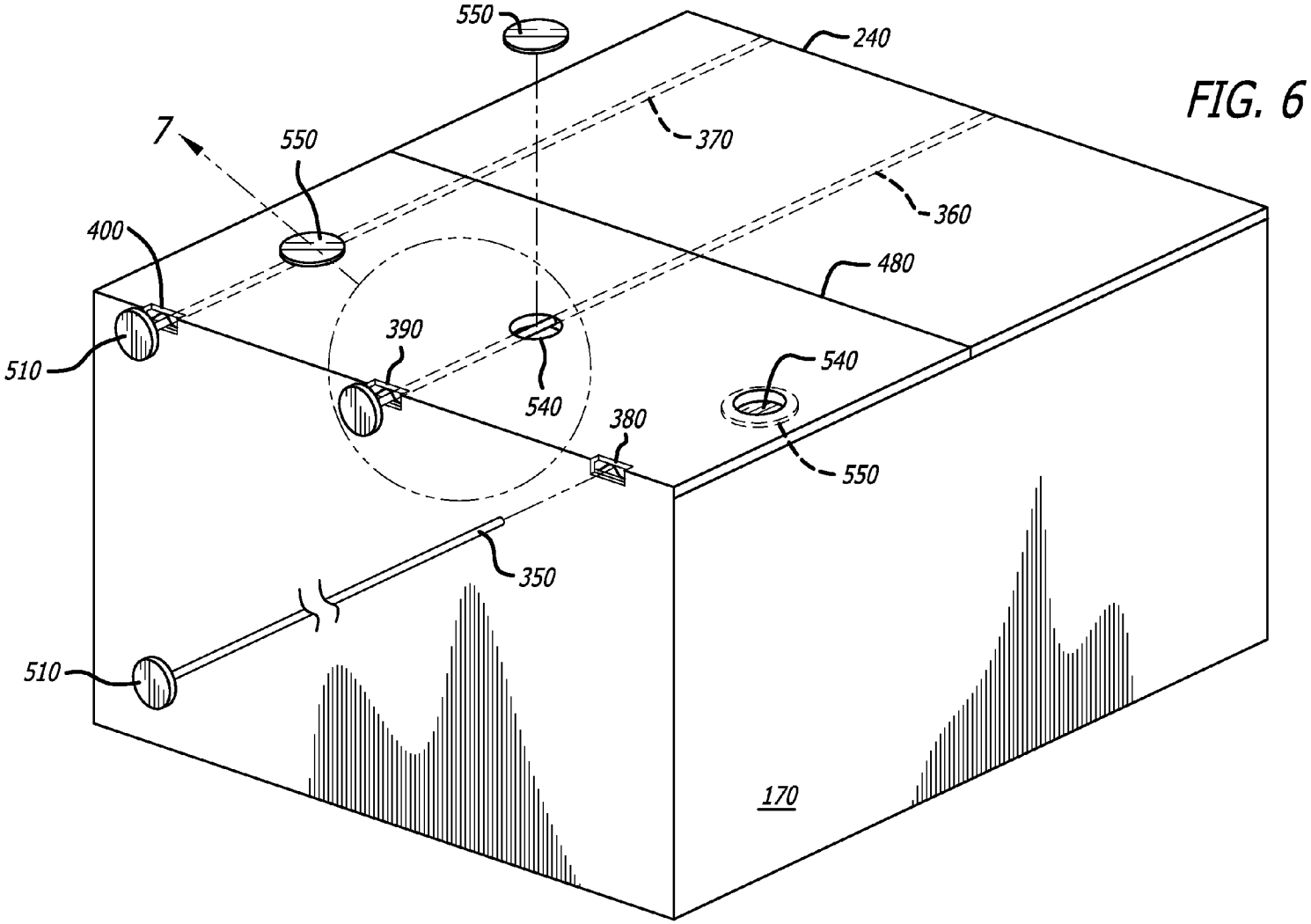
FIG. 6 is a view similar to FIG. 2 of an alternative embodiment of the rods, the flaps and the stickers.
Figure 7A:
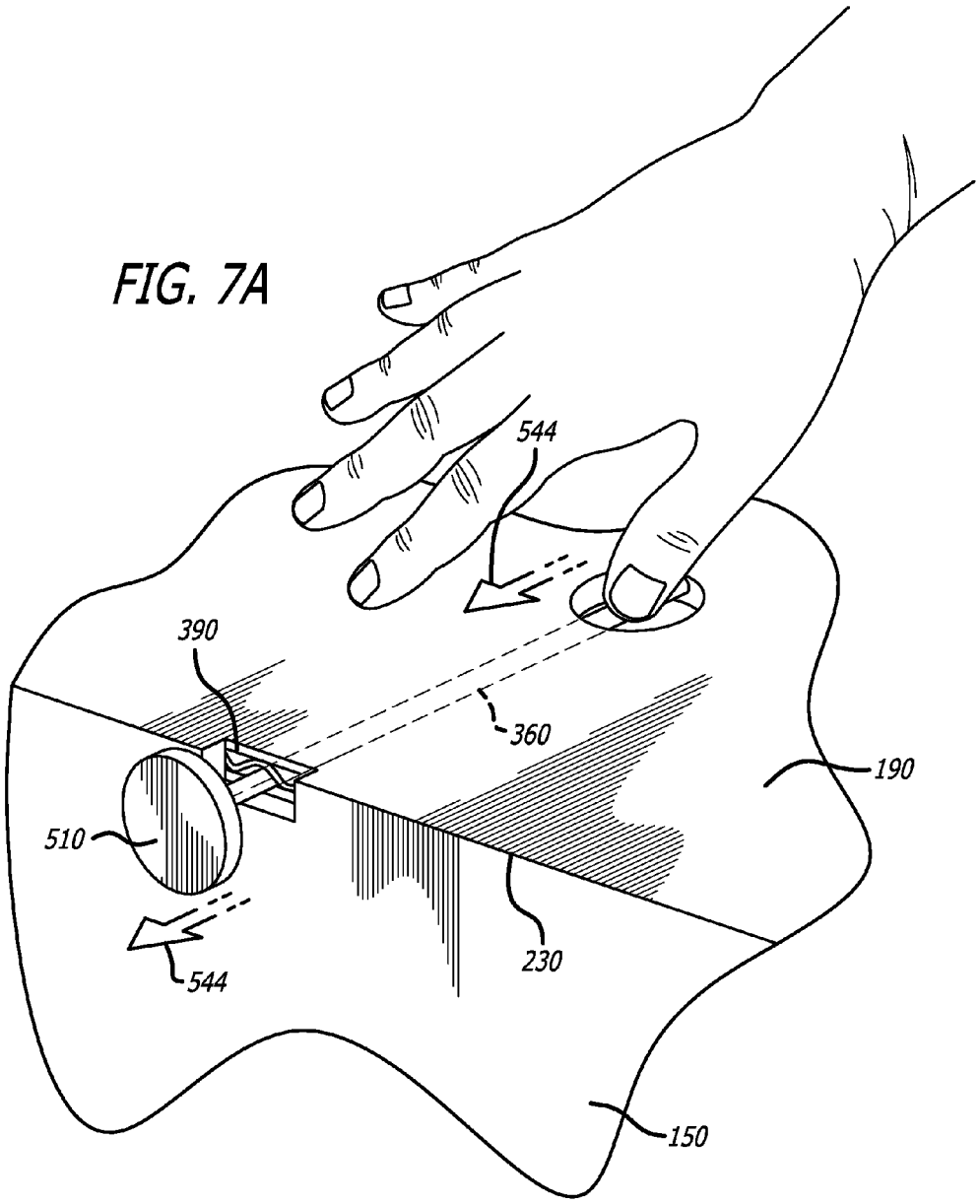
FIG. 7A is an enlarged view taken on circle 7 of FIG. 6 and showing a user moving a rod via the opening.
Figure 7B:
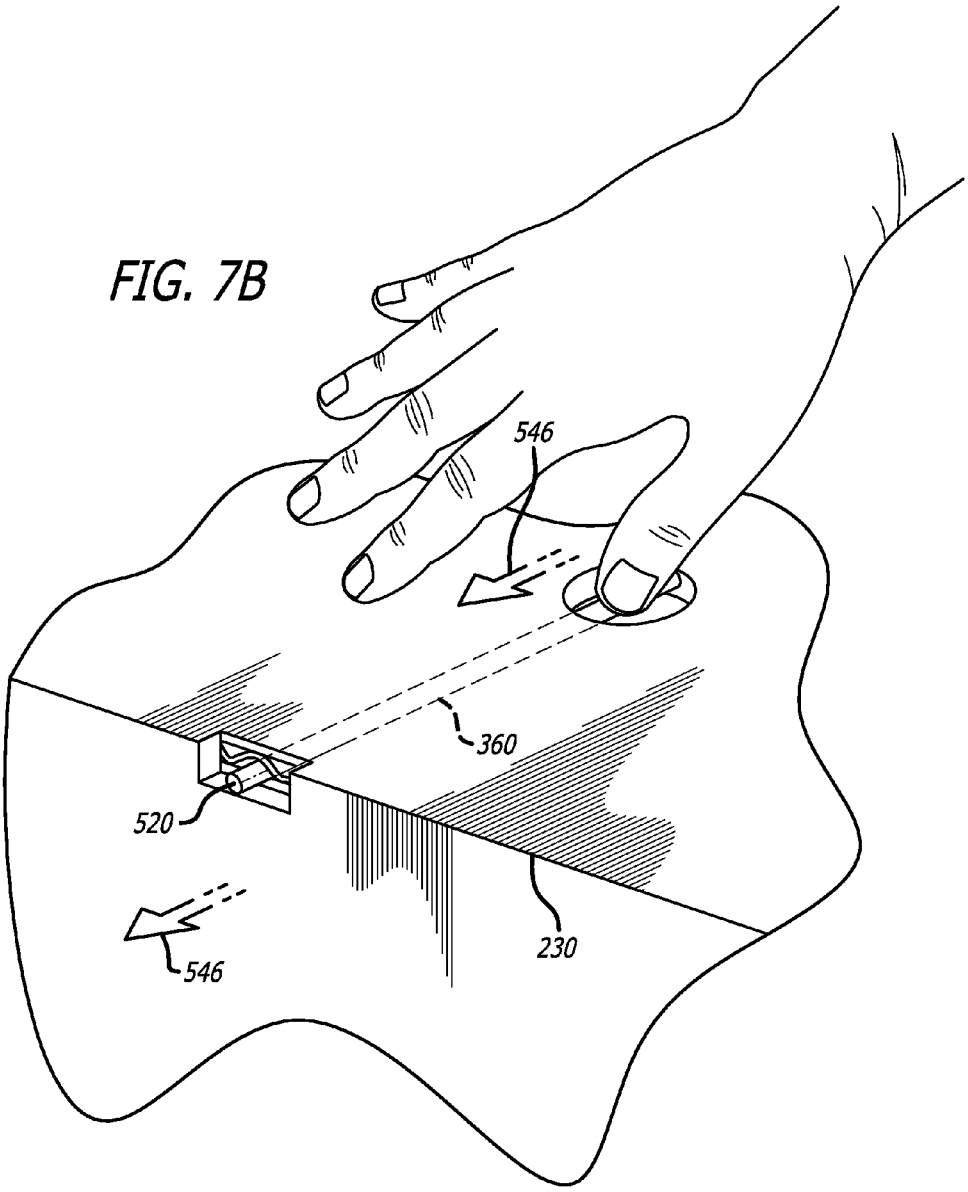
FIG. 7B is a view similar to FIG. 7A of an alternative rod embodiment.

As mentioned above a number of constructions/configurations of the rod(s) are possible. One is to have a proximal end bent portion, as depicted in FIGS. 2 and 3 at 500. The user can easily grasp this end 500 and thereby maneuver the rod in assembly and disassembly procedures. Instead of a bent portion 500, a knob 510 can be provided as shown in FIGS. 6 and 7A. Or the end can be a plain end as shown in FIG. 7B, for example, at 520. Alternatively (or additionally) the rod can have a slight bow with the distance of the center of the bow to a line connecting the ends being about 0.03 to 0.06 inch as can be understood from rod 530 in FIG. 8A, and approximately the thickness of the cardboard flap. This slight bow or bend can help keep the rod 530 in place and make it less likely to slide out during use of the assembled box construction. Although it is anticipated that all rods in the set will conveniently have the same construction and configuration, such is not required by this disclosure.

To assist in removing (or inserting) rods from (into) operative positions, especially where they have plain ends 520, holes 540 can be provided in the first (or second) flap 190, each aligned with a respective fold-line hole 380, 390, 400. The holes 540 are depicted in FIGS. 6, 7A and 7B, and can have diameters such as between ⅜ and one inch. They provide through-access for a user's thumb or fingers (or an instrument) to contact the rod and push it out as depicted by the arrows 544, 546 in FIGS. 7A and 7B.

Removable and replaceable stickers (or decals) 550, as shown in FIG. 6, can be provided to cover the holes 540 when the rods are not being inserted or removed. This is to prevent dust and the like from entering the box (or loose small articles in the box from falling out). Three stickers 550 are shown in this drawing figure. The one on the left is in place, and the one in the middle is ready for adherence (or has recently been removed). The one on the right is an alternative sticker placement, namely on the inside surface of the flap. This alternatively placed sticker can be affixed and need not be removable, since the rod is operatively accessible by a user (FIGS. 7A and 7B) through the open top surface of the holes 540.

Figures 8A, 8B, 8C:
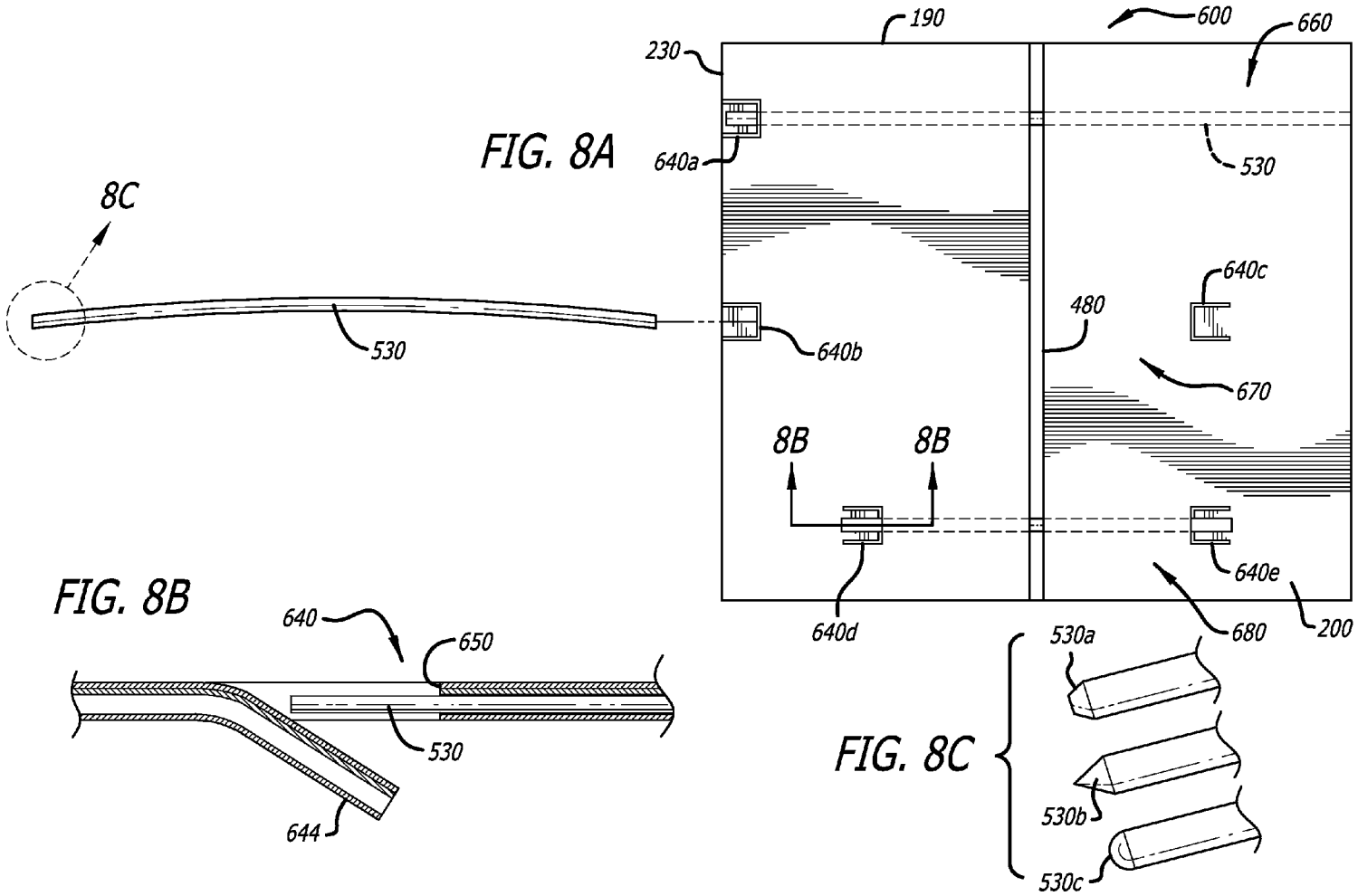
FIG. 8A is a top view of a further alternative embodiment showing three alternative fold-down punch-out arrangements for the rods, one of the curved rods thereof being inserted into position in the middle arrangement, and the rods in position in the outer two arrangements.
FIG. 8B is an enlarged cross-sectional view taken on line 8B-8B of FIG. 8A.
FIG. 8C is an enlarged view taken on circle 8C of FIG. 8A and showing three alternative rod end configurations.

An alternative construction of the disclosure is shown in FIG. 8A generally at 600. Referring thereto, instead of a hole through the fold line and both the flap and panel, a recess in the first flap 190 can be provided. This recess can be defined by a push-down (or fold-down punch-out) flap 640 that folds down and defines an open corrugated edge 650 in the flap (see, e.g., FIG. 8B). The fold-down punch-out flap 640 can have dimensions of ½ by ½ inch. The rod 530 can then be inserted over the folded down flap 644 and into the corrugations of the open corrugated edge 650, through the first flap 190, across the "divide" 480 and into and a distance into the second flap 200, as can be understood from the dotted lines in FIG. 8A and the enlarged view of FIG. 8B which shows the relationship of the flap and the rod end.

The rod end can have any of a number of alternative configurations as shown in FIG. 8C by chamfered end 530*a*, pointed/skewer end 530*b*, and rounded end 530*c*.

A sticker covering the exposed end of the rod in FIGS. 3, 7A, 7B and 8, for example, can be provided. This would confirm that the box has not been opened by an unauthorized person.

Three different embodiments of the fold-down punch-out flap construction are shown in the box construction of FIG. 8A generally at 660, 670, 680. While a box construction can include two or three of these embodiments it is anticipated that a box construction would include the same embodiment for each rod. One of the embodiments 660 is with the flap 640*a* at the first fold line 230 as mentioned above and as shown at the top of FIG. 8A.

A second of the embodiments 670 is shown in the middle of FIG. 8A and includes the fold-down punch-out flap 640*b* at the fold line 230 of the first embodiment and a second fold-down punch-out flap 640*c* in a central location of the second flap 200. The distal end of the rod, when in its operative position, can extend out the second fold-down punch-out flap 640*c* in a position similar to that of the proximal end of the rod in the first fold-down punch-out flap 640*a* and as shown in the first embodiment 660 and in FIG. 8B. The second fold-down punch-out flap 640*c* provides convenient access to the distal rod end for an alternative removal operation. By engaging the end of the rod it also helps hold the rod in place.

The third embodiment 680 is shown at the "bottom" of FIG. 8A and has the second fold-down punch-out flap 640*e* in the second flap 200 similar to the second embodiment 670. And the first fold-down punch-out flap 640*d* is positioned in the central part of the first flap 190 and not at the fold line 230. This embodiment has the advantages of shorter rods and thereby lower manufacturing costs.

A further alternative construction is shown in FIGS. 9A, 9B and 10-12 generally at 700. It includes a set (one or more) of rods 140 and a novel cardboard carton blank 710. The set of rods 140 can include three rods 350, 360, 370, such as straight or bowed ones and those with plain ends, such as those shown in FIG. 8C. The first flap 190 can have at its distal end three (for example) indents or notches 730. It can also have three holes 740 at central locations, and each aligned with a respective one of the notches 730. The notches 730 can have a (short) dimension of ½ inch and a (longer) dimension of ¾ inch, as shown by the alternative wider configuration in FIG. 9B. Instead of a rectangular shape, the notches can be configured as semi-circles (not shown) with diameters of ¾ inch, for example. And the holes 740 can have diameters of ¼ inch, for example.

Figure 9A:
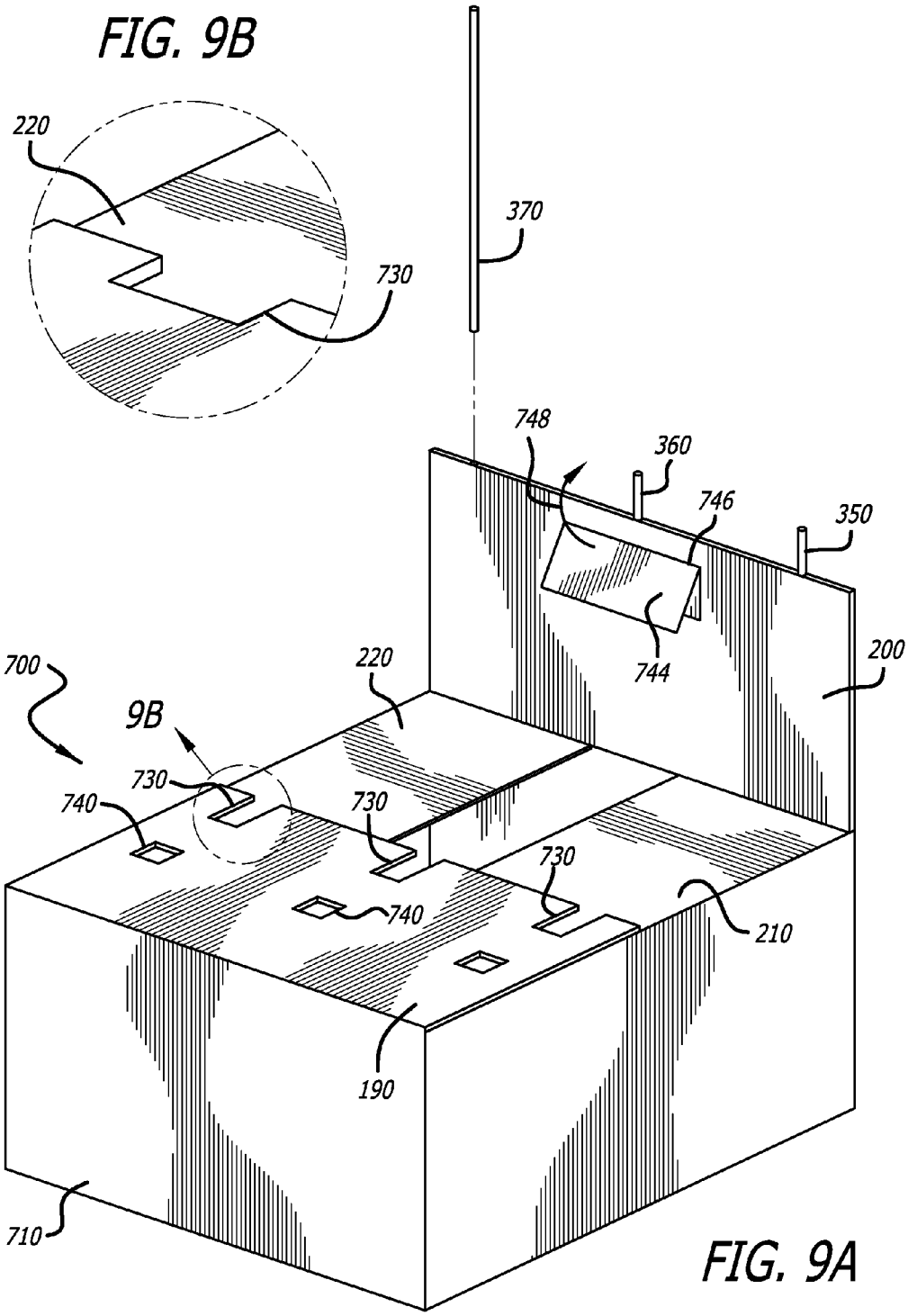
FIG. 9A is a (bottom) perspective view similar to FIG. 2, showing an assembly step of a yet further alternative embodiment.

FIG. 9A also shows a dust shield 744 in a storage position folded on a fold line 746 with an arrow 748 showing the repositioning thereof to an operative position as discussed later with reference to FIG. 13.

Figure 10:
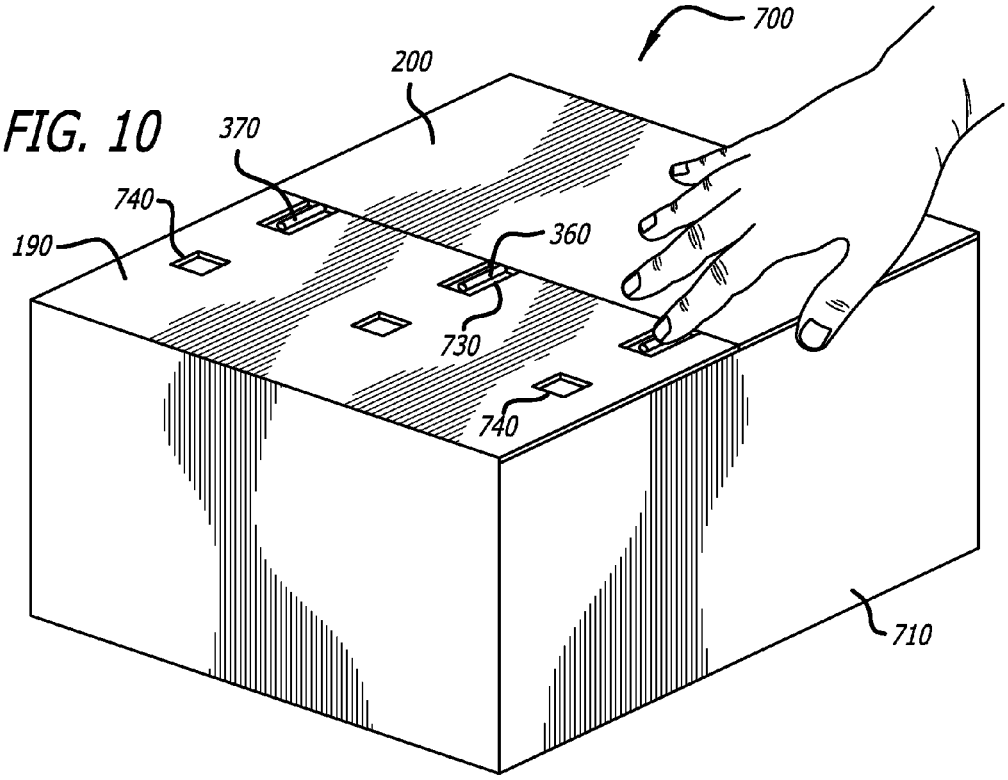
FIG. 10 is a perspective view of the embodiment of FIG. 9A showing a further assembly step.

Insertion of the rods 350, 360, 370 into operative positions is a different process for construction 700 than that of the two previously discussed embodiments/constructions; however, the resulting operative positions are similar, namely extending in and between the two flaps 190, 200. It may be that the rods are slightly shorter and thus do not extend the full extents into the widths of the two flaps than the two previously discussed constructions. The rods 350, 360, 370 are inserted into corrugations of the second flap 200 through the distal exposed edge 750, as can be understood from FIG. 9A. With both flaps 190, 200 folded down, as shown in FIG. 10, the exposed ends 760 of the rods 350, 360, 370 fit into respective ones of the notches 730. The rods are then pushed/moved through the corrugated edges at the notches 730 such as by the user's fingers (or a tool) as shown in FIG. 10 and a distance into the first flap 190, as shown in FIG. 11.

Figure 11:
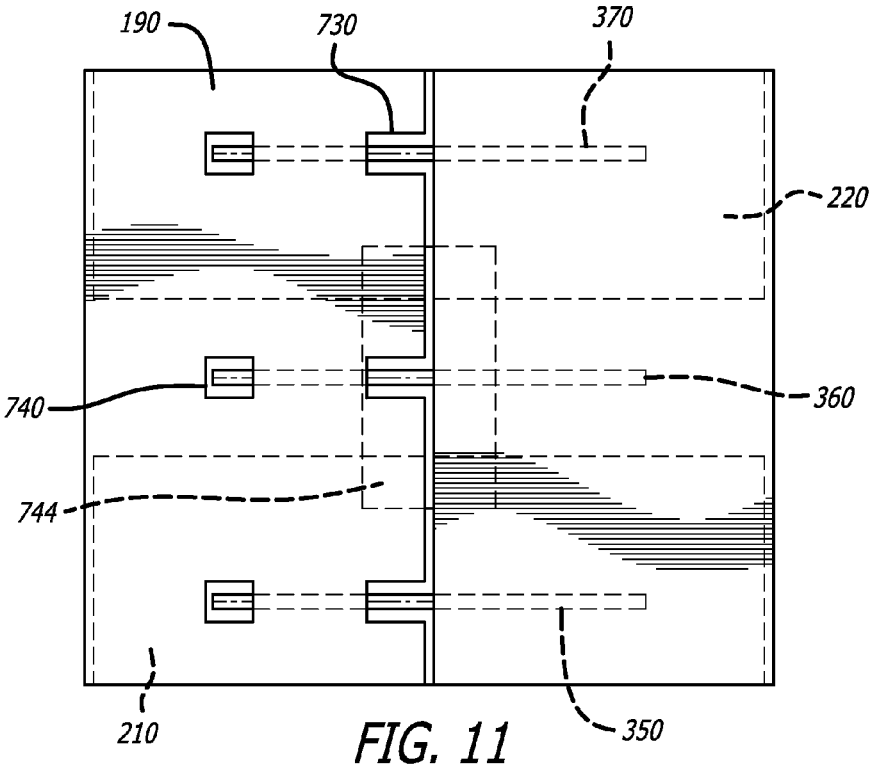
FIG. 11 is a top plan view of the embodiment of FIG. 10 showing a yet further assembly step.

The holes 740 can form windows to show the user when the rods 350, 360, 370 have been extended a sufficient distance into the first flap 190, as when the ends 760 are visible through the holes (FIG. 11). Alternatively or in addition, the holes 740 can provide access to the rods for moving them into or out of position. To disassemble the cardboard box construction 700, the rods are moved in an opposite direction to positions as shown in FIG. 9A. The rods 350, 360, 370 can be left in that position for storage or can be removed and positioned elsewhere together with (or separate from) the folded-down cardboard blank 710.

Figure 12:
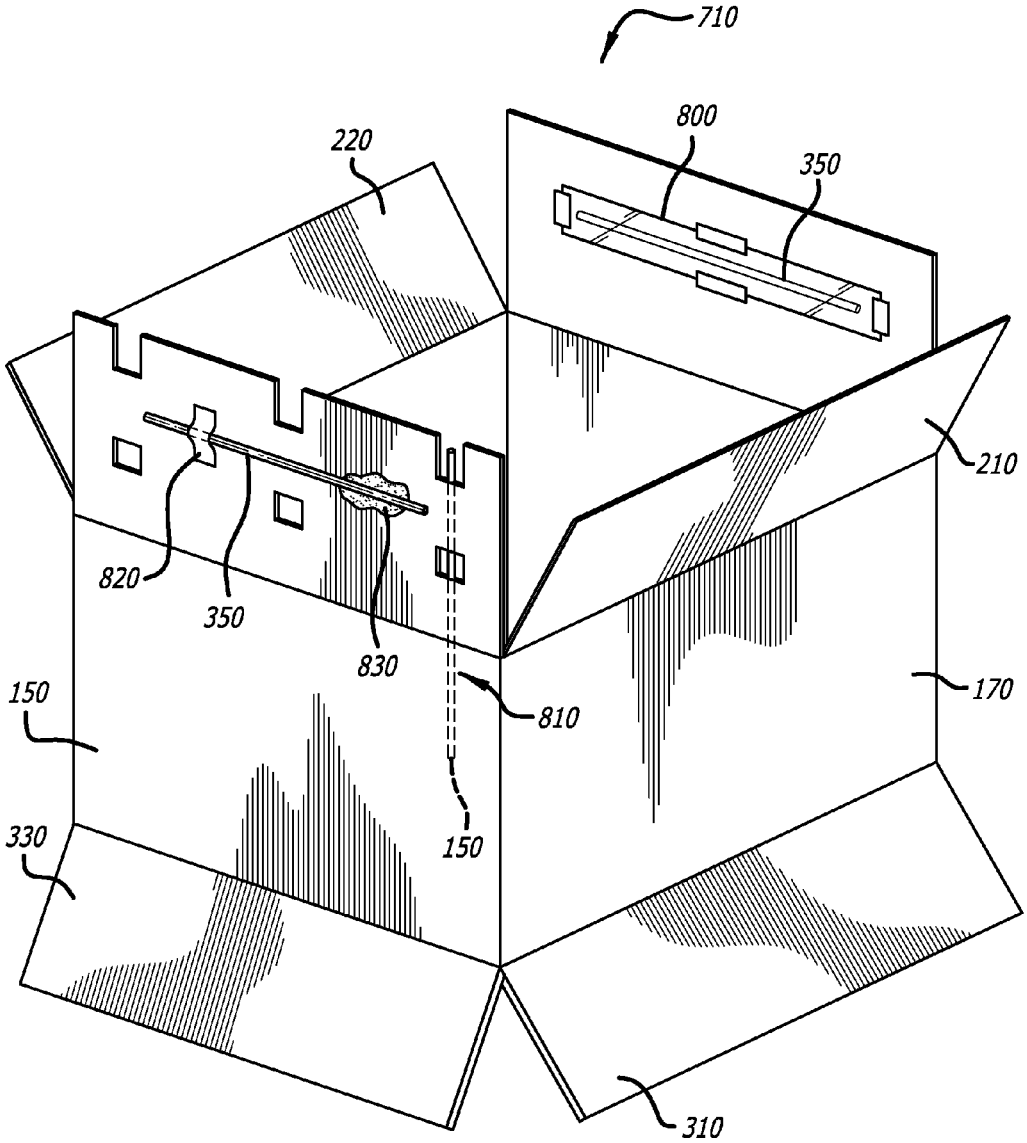
FIG. 12 is a perspective view of a variation of the embodiment of FIG. 9A after disassembly, and showing three alternative rod storage arrangements.

Other rod storage securement methods/means can include a storage packet 800 on an inside surface of a flap or panel, such as shown in FIG. 12. The storage packet 800 can be attached to the inside surface by glue, staples, or the like, and when the rods are in the operative positions the packet can be in a folded out position to define a dust cover. Another method/means is to insert the rod 350 in through the corrugations of one of the flaps and down into the adjoining panel, as depicted in FIG. 12 at 810. Also depicted in FIG. 12 is yet another method/means, which includes the rod 350 being releasably adhered flat to a surface of one of the flaps such as by using tape 820 and/or gummy glue 830.

Figure 13:
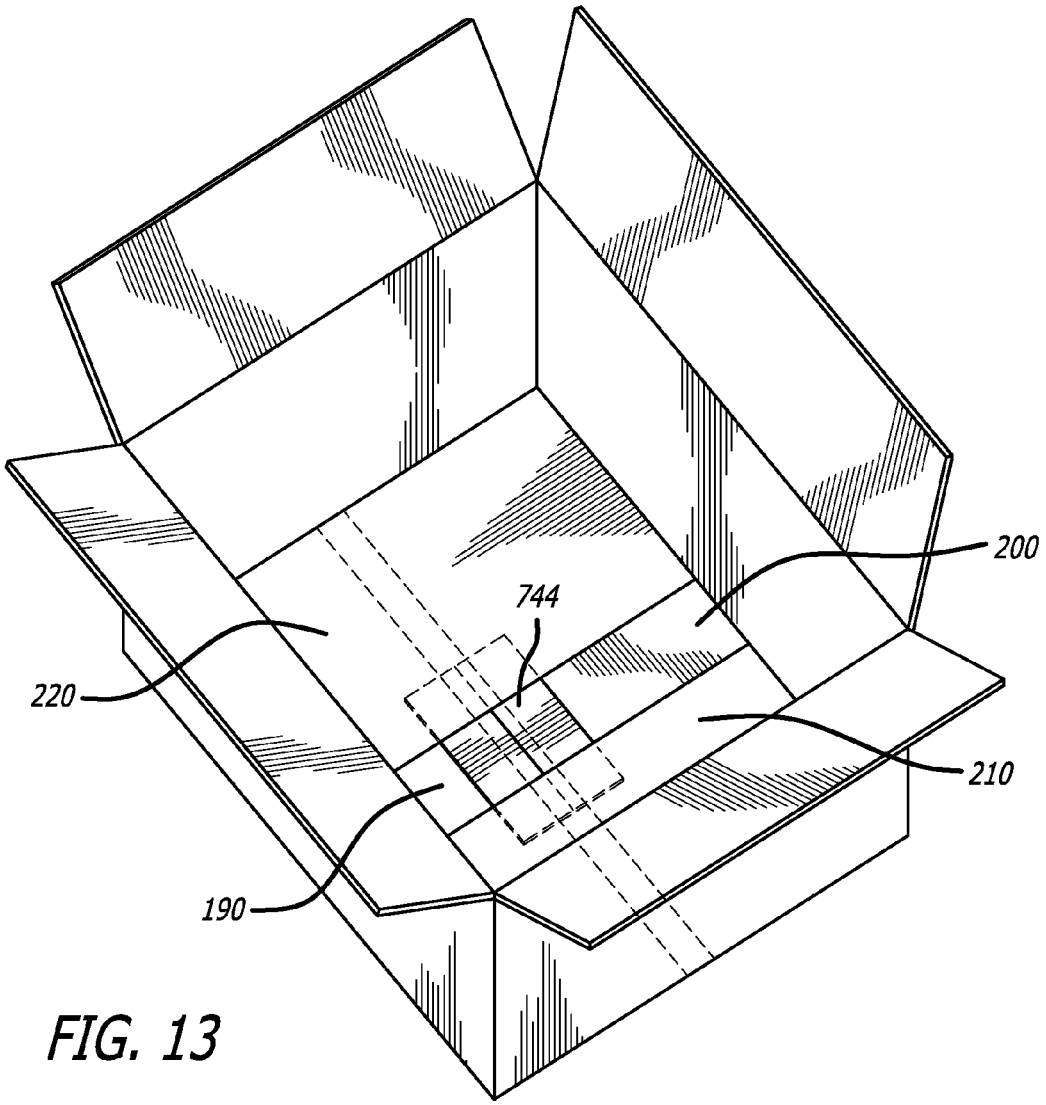
FIG. 13 is a top perspective view of the box of FIG. 9A, for example, and showing a dust shield of the disclosure unfolded and in place.

FIG. 13 is a perspective view of a box construction of the present disclosure looking down into box with the top flaps in an open condition and the bottom flaps closed. The dust shield 744 (of FIG. 9A) is shown in FIG. 13 unfolded and positioned sandwiched between the first and second flaps 190, 200 and the third and fourth flaps 210, 220 and over the divide 480 between the first and second flaps.

The rods and flap constructions of this disclosure can be used in box constructions that do not have top flaps, that is, are open at the top. They can be used in boxes that have separate lids (such as in banker-type boxes). They can even be used in box constructions that do not have the (inner) third and fourth flaps. A box construction whose panels are not corrugated is also within the scope of the disclosure.

Although the present inventions have been described in terms of preferred and alternative embodiments above, numerous modifications and/or additions to the above-described embodiments would be readily apparent to one skilled in the art. The embodiments can be defined as methods of use carried out by anyone, any subset of or all of the components and/or users; as systems of one or more components in a certain structural and/or functional relationship; and/or as subassemblies or sub-methods. The inventions can include each of the individual components separately. The inventions can include the rods by themselves, the carton blanks by themselves, the methods of making the carton blanks and/or the methods of making the rods. It can also include different combinations of the rod constructions and blank constructions. However, it is intended that the scope of the present inventions extend to all such modifications and/or additions and that the scopes of the present inventions are limited solely by the claims set forth herein.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including" and "having" are inclusive and therefore specify the presence of stated features, integers, steps, operations, elements and/or components, but do not preclude the presence or addition of one or more other features, integers, steps, operations, elements, components and/or groups thereof. The method steps, processes and operations described herein are not to be construed as necessarily requiring their performance in the particular order discussed or illustrated, unless specifically identified as an order of performance. It is also to be understood that additional or alternative steps may be employed.

Although the terms first, second, third and so forth may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second" and other numerical terms when used herein do not imply a sequence or order unless clearly indicated by the context. Thus, a first element, component, region, layer or section discussed below can be termed a second element, component, region, layer or section without departing from the aspects of the present teachings.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (such as "between" versus "directly between," and "adjacent" versus "directly adjacent"). As used herein, the term "and/or" includes any and all combinations of one or more of the associated listed items.

Spatially relative terms, such as "inner," "outer," "beneath," "below," "lower," "upper," "above," "forward," "top," "bottom," and "rearward," may be used herein for ease of description to describe one element's or feature's relationship to another, but the disclosure is intended to encompass different orientations of the device in use or operation in addition to the orientation depicted in the figures. For example, if the device (e.g., box construction) in the figures is turned over, elements described as "below" or "beneath" other elements or features would then be oriented "above" the other elements or features. Thus, the example term "below" can encompass both an orientation of above and below. The device may be otherwise oriented (rotated ninety degrees or at other orientations) and the spatially relative descriptors used herein interpreted accordingly.

What is claimed is:

1. A cardboard box construction, comprising:

a cardboard carton blank having opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap;

a rod;

a hole passing through an outwardly-disposed surface of the first flap and/or the first panel and at the first fold line and providing access from a box exterior to corrugations of the first flap;

the cardboard carton blank and the rod being configured such that the rod can be positioned in an operative position extending between the first and second flaps, and within corrugations of both of the first and second flaps and holding the first and second flaps in folded-down closed positions with distal edges of the first and second flaps adjacent one another, the third and fourth flaps folded inside of the first and second flaps and the rod extending across a divide between the adjacent distal edges; and the rod being configured to be positioned into the operative position by inserting an end thereof from the box exterior into the hole and thereby into the corrugations of the first flap and pushing the end through the first flap, across the divide and into corrugations of the second flap and to the operative position.

2. The construction of claim 1 wherein the rod when in the operative position is entirely below a top surface plane of the first and second flaps across the divide and no portion of the rod extends into corrugations of the first or second panels.

3. The construction of claim 1 wherein the cardboard carton blank and the rod are configured such that the cardboard carton blank can be broken down to a storage condition and the rod can be repositioned from the operative position to a removed, storage position relative connected to the broken-down cardboard carton blank.

4. The construction of claim 1 wherein the hole crosses over the first fold line and is in the first panel and the first flap.

5. A cardboard box construction, comprising:

a cardboard carton blank having opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap;

a rod;

the first flap includes a fold-down punch-out which communicates a box exterior with corrugations of the first flap and which is defined at least in part by a pre-formed weakened line;

the cardboard carton blank and the rod being configured such that the rod can be positioned in an operative position extending between the first and second flaps, and within corrugations of both of the first and second flaps and holding the first and second flaps in folded-down closed positions with distal edges of the first and second flaps adjacent one another, the third and fourth flaps folded inside of the first and second flaps and the rod extending across a divide between the adjacent distal edges; and the rod is configured to be positionable in the operative position by inserting an end thereof into the fold-down punch-out and thereby into the corrugations of the first flap and pushing the end through the first flap, across the divide and into corrugations of the second flap.

6. The construction of claim 5 wherein the fold-down punch-out is positioned at the first fold line.

7. The construction of claim 5 wherein the fold-down punch-out is positioned at a central location of the first flap.

8. The construction of claim 5 wherein the fold-down punch-out defines a first fold-down punch-out, and the second flap includes a second fold-down punch-out aligned with the first fold-down punch-out and for an opposite end of the rod.

9. The construction of claim 5 wherein at least one end of the rod is outside of the corrugations when the rod is in the operative position.

10. A cardboard box construction, comprising:

a cardboard carton blank having opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap;

a rod;

the first flap including a cut-out on a distal edge thereof and providing access into corrugations of the first flap;

the cardboard carton blank and the rod being configured such that the rod can be positioned in an operative position extending between the first and second flaps, and within corrugations of both of the first and second flaps and holding the first and second flaps in folded-down closed positions with distal edges of the first and second flaps adjacent one another, the third and fourth flaps folded inside of the first and second flaps and the rod extending across a divide between the adjacent distal edges; and the rod being configured to be positionable in the operative position by inserting one end thereof into corrugations of the second flap through a distal edge of the second flap and with an opposite rod end extending out from the second flap and then with the first and second flaps folded down and the opposite rod end in the cut-out and the rod extending across the divide, inserting an opposite rod end into the corrugations of the first flap at the cut-out.

11. The construction of claim 10 wherein the first flap includes a through-hole which is aligned with the cut-out and configured to assist in positioning of the rod.

12. A cardboard box construction, comprising:

a cardboard carton blank having opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the fourth panel and the fourth flap;

a rod;

a hole passing through an outwardly-disposed surface of the first flap and/or the first panel and providing access to corrugations of the first flap;

the cardboard carton blank and the rod being configured such that the rod can be positioned in an operative position extending between the first and second flaps, and within corrugations of both of the first and second flaps and holding the first and second flaps in folded-down closed positions with distal edges of the first and second flaps adjacent one another, the third and fourth flaps folded inside of the first and second flaps and the rod extending across a divide between the adjacent distal edges; and the rod being configured to be positioned into the operative position by manipulating the rod including inserting an end thereof into the hole and thereby into the corrugations of the first flap and then manipulating the rod such that the rod extends across the divide and entirely below a top surface plane of the first and second flaps and through corrugations of the first and second flaps and with neither end of the rod extending into corrugations of the first or second panels.

13. The construction of claim 12 wherein the hole is defined by a fold-down punch-out with a flap thereof pushed down.

14. The construction of claim 12 wherein the hole crosses over the first fold line.

15. The construction of claim 12 wherein the hole is a cut-out at a distal edge of the first flap.

16. The construction of claim 12 wherein at least one end of the rod is outside of the corrugations when the rod is in the operative position.

17. A method of assembling a cardboard box construction, comprising:

positioning a rod relative to a cardboard carton blank, which has opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the second side panel and the second side flap;

the positioning includes inserting the rod so that the rod extends between the first and second flaps and within corrugations of both of the first and second flaps and to an operative position holding the first and second flaps in folded-down closed positions with distal edges of the first and second flaps adjacent one another, the third and fourth flaps folded inside of the first and second flaps and the rod extending across a divide between the adjacent distal edges; and the inserting includes inserting an end of the rod into a hole that is in and passes through an outwardly-disposed surface of the first flap and/or the first panel and thereby into exposed corrugations of the first flap.

18. The method of claim 17 wherein the hole is across the first fold line and thereby in the first flap and the first panel.

19. The method of claim 17 wherein the hole is in the first flap.

20. The method of claim 19 wherein the hole is formed when a fold-down punch-out flap is pushed down.

21. The method of claim 17 wherein the hole is positioned adjacent the first fold line.

22. The method of claim 17 wherein the hole is positioned a distance way from the first fold line towards a distal edge of the first flap.

23. The method of claim 17 wherein the rod when in the operative position has the end thereof extending out a hole in the second flap.

24. The method of claim 17 wherein no portion of the rod extends into corrugations of the first or second panels when the rod is in the operative position.

25. The method of claim 17 wherein one of the first flaps has a central through-hole and the positioning includes moving the rod by manipulating the rod through the central through-hole towards the operative position.

26. The method of claim 17 wherein at least one end of the rod is outside of the corrugations when the rod is in the operative position.

27. A method of assembling a cardboard box construction, comprising:

positioning a rod relative to a cardboard carton blank, which has opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the second side panel and the second side flap;

the positioning includes inserting the rod so that the rod extends between the first and second flaps and within corrugations of both of the first and second flaps and to an operative position holding the first and second flaps in folded-down closed positions with distal edges of the first and second flaps adjacent one another, the third and fourth flaps folded inside of the first and second flaps and the rod extending across a divide between the adjacent distal edges; and the rod when in the operative position being entirely below a top surface plane of the first and second flaps across the divide and no portion of the rod extending into corrugations of the first or second panels.

28. The method of claim 27 wherein the inserting includes inserting an end of the rod through a first panel hole which passes through an outwardly-disposed surface of the first panel, and into an exposed corrugation edge of the first flap.

29. The method of claim 28 wherein the hole is formed by pushing down on a pre-formed flap of the first flap.

30. The method of claim 27 wherein one of the first and second flaps has a central through-hole; and the positioning includes moving the rod relative to the first panel by manipulating the rod through the central through-hole towards the operative position.

31. The method of claim 27 further comprising:

the rod defining a first rod;

positioning a second rod relative to the first and second flaps; and the positioning the second rod includes inserting the second rod so that the second rod extends between the first and second flaps and within corrugations of both of the first and second flaps and to an operative position holding the first and second flaps in the folded-down closed positions with the second rod extending across the divide, the second rod being entirely below the top surface plane across the divide and neither end of the second rod extending into corrugations of the first or second panels.

32. The method of claim 27 further comprising removing the rod from the operative position and out an opening in the cardboard carton blank for storage and subsequent re-assembly of the cardboard box construction.

33. The method of claim 27 wherein at least one end of the rod is outside of the corrugations when the rod is in the operative position.

34. A method of assembling a cardboard box construction, comprising:

positioning a rod relative to a cardboard carton blank, which has opposing first and second panels, opposing third and fourth panels, opposing first and second flaps, opposing third and fourth flaps, a first fold line between the first panel and the first flap, a second fold line between the second panel and the second flap, a third fold line between the third panel and the third flap, and a fourth fold line between the second side panel and the second side flap;

the positioning includes inserting the rod so that the rod extends between the first and second flaps and within corrugations of both of the first and second flaps and to an operative position holding the first and second flaps in folded-down closed positions with distal edges of the first and second flaps adjacent one another, the third and fourth flaps folded inside of the first and second flaps and the rod extending across a divide between the adjacent distal edges;

the first flap including a cut-out on a distal edge thereof and providing access into corrugations of the first flap; and the inserting including inserting an end of the rod into corrugations of the second flap through a distal edge of the second flap and with an opposite end of the rod extending out from the second flap and then with the first and second flaps folded down and the opposite rod end in the cut-out and the rod extending across the divide, inserting the opposite rod end into the corrugations of the first flap at the cut-out.

35. The method of claim 34 wherein the first flap includes a through-hole and the inserting the opposite rod end includes moving the rod towards the operative position by manipulating the rod through the through-hole and/or viewing the opposite rod end through the through-hole.

36. The method of claim 34 further comprising moving the rod from the operative position to a storage position relative to the cardboard carton blank with the first and second flaps moved away from the folded down positions.

* * * * *